US007921574B2

(12) United States Patent
Bäckström et al.

(10) Patent No.: US 7,921,574 B2
(45) Date of Patent: Apr. 12, 2011

(54) RULER WITH SAFETY SHIELD

(75) Inventors: Mikael Bäckström, Chicago, IL (US); Keith D. Alsberg, Chicago, IL (US)

(73) Assignee: Square 1 Product Development, Inc., Chicago, IL (US)

( * ) Notice: Subject to any disclaimer, the term of this patent is extended or adjusted under 35 U.S.C. 154(b) by 89 days.

(21) Appl. No.: 11/698,370

(22) Filed: Jan. 26, 2007

(65) Prior Publication Data

US 2008/0178482 A1 Jul. 31, 2008

(51) Int. Cl.
*B43L 7/033* (2006.01)

(52) U.S. Cl. ..... 33/482; 33/492

(58) Field of Classification Search ..... 33/483–489, 33/481, 491–494

See application file for complete search history.

(56) References Cited

U.S. PATENT DOCUMENTS

| | | | | |
|---|---|---|---|---|
| 287,480 | A * | 10/1883 | Smith | 33/483 |
| 781,117 | A | 1/1905 | Willitts | |
| 963,001 | A | 6/1910 | Dibrell | |
| 2,634,504 | A | 4/1953 | Jennings, Jr. | |
| 3,406,456 | A | 10/1968 | Schleich | |
| 5,461,795 | A * | 10/1995 | Kok | 33/483 |
| D364,177 | S | 11/1995 | Lewis | |
| 5,471,755 | A | 12/1995 | Haskell | |
| D390,078 | S | 2/1998 | Williams | |
| 5,842,402 | A | 12/1998 | Collier | |
| 5,873,171 | A | 2/1999 | Hsu | |
| 5,960,554 | A * | 10/1999 | Kamykowski | 33/562 |
| 6,349,479 | B1 | 2/2002 | Bottega | |
| 6,782,629 | B2 * | 8/2004 | Jimenez et al. | 33/483 |

* cited by examiner

*Primary Examiner* — Yaritza Guadalupe-McCall
(74) *Attorney, Agent, or Firm* — Brinks Hofer Gilson & Lione

(57) ABSTRACT

A tool for aiding marking or cutting is described. A V-shaped member having an edge formed at an exterior apex of the V for guiding a marker or cutting tool. The exterior surfaces of the V-shaped member may have a material applied having a higher coefficient of friction than that of the V-shaped member. The edge at the apex of the V may have two substantially planar surfaces, each of which forms a complimentary angle with the interior apex angle of the V, or a thin metal portion formed in the exterior apex of the V so that an edge thereof protrudes sloping towards a surface on which the tool is laid. A graduated scale may be applied to an exterior surface of the tool at a location near the apex.

20 Claims, 5 Drawing Sheets

RULER WITH SAFETY SHIELD

TECHNICAL FIELD

This application relates to a device which protects a user's hand from injury by a cutting implement when performing a cutting operation.

BACKGROUND

When using a ruler, a straight edge or scribe guide to aid in cutting a straight line in paper, fabric or other material, a sharp instrument is used. The sharp instrument may be a knife with a disposable or replaceable blade, a sharpened rolling disk attached to a handle or similar cutting device. The ruler is usually held in place by placing one hand on top of the ruler to position the ruler such that it is aligned with the line of the cut and firmly pressing down on the flat surface of the ruler. The cut is performed by drawing the cutting device along an edge of the ruler along a length thereof using the other hand. To ensure that the cut follows the straight line of the edge of the ruler, the blade of the cutting device may be positioned so that it contacts the edge of the ruler, and is held against the ruler by applying a transverse force to the cutting device while also performing the cutting operation. Rulers often have a tapered edge so that the edge portion contacting the cutting device is thinner than the remainder of the transverse cross section, so as to assist in accurately positioning a drawing or cutting implement with respect to the desired line when using the ruler.

The transverse force applied to the cutting device may cause the blade or sharp edge of the cutting device to ride up onto the tapered edge of the ruler and further towards the center of the transverse section, where the first hand is positioned. This may result in cutting injuries to the fingers of the user.

SUMMARY

A tool or cutting aid is described having a substantially V-shaped cross section and a length appropriate to the task for which it has been selected is described. The cutting aid may be used by positioning the apex of the V-shaped cross section so that the length of the cutting aid substantially coincides with a line to be cut with a cutting device. One of the external surfaces of the cutting aid may be laid flat against the material to be cut. The user may place one hand on an internal surface of the cutting aid corresponding to the external surface laid against the material and apply pressure to the internal surface to hold the cutting aid in position.

In another aspect, a material having non-skid properties may be applied to a portion of the external surface of the cutting aid along a length thereof in a position distal form the apex of the V-shaped cross section, so that when pressure is applied to the internal surface of the cutting aid corresponding to the external surface, the cutting aid is inhibited from slipping with respect to the material to be cut.

In a further aspect, the non-skid material may be applied to the edges of the surfaces distal from the apex of the V-shaped cross section.

In still a further aspect, a ruler gradation may be applied an external surface of the cutting aid in a position proximal to the apex of the V-shaped cross section. The ruler gradations may be of any suitable measuring scale, such as inches, meters, architectural gradations, or a special purpose measure.

In yet another aspect, a thin strip may be formed in, or inserted in, the apex of the V-shaped cross section, extending outward therefrom, to form an edge oriented along the length of the cutting aid. The edge may disposed so as to bisect the exterior angle of the V-shaped cross section, and have a projection from the apex of the V-shaped cross section that brings the projecting edge of the strip in closer proximity to the material to be cut, when a external surface side of the V-shaped cross section is laid on a surface of a material to be cut.

DETAILED DESCRIPTION

The examples described herein may be better understood with reference to the drawings, but these examples are not intended to be of a limiting nature. Like numbered elements in the same or different drawings perform equivalent functions. When a specific feature, structure, or characteristic is described in connection with an example, it will be understood that one skilled in the art may effect such feature, structure, or characteristic in connection with other examples, whether or not explicitly stated herein.

Figure 1:
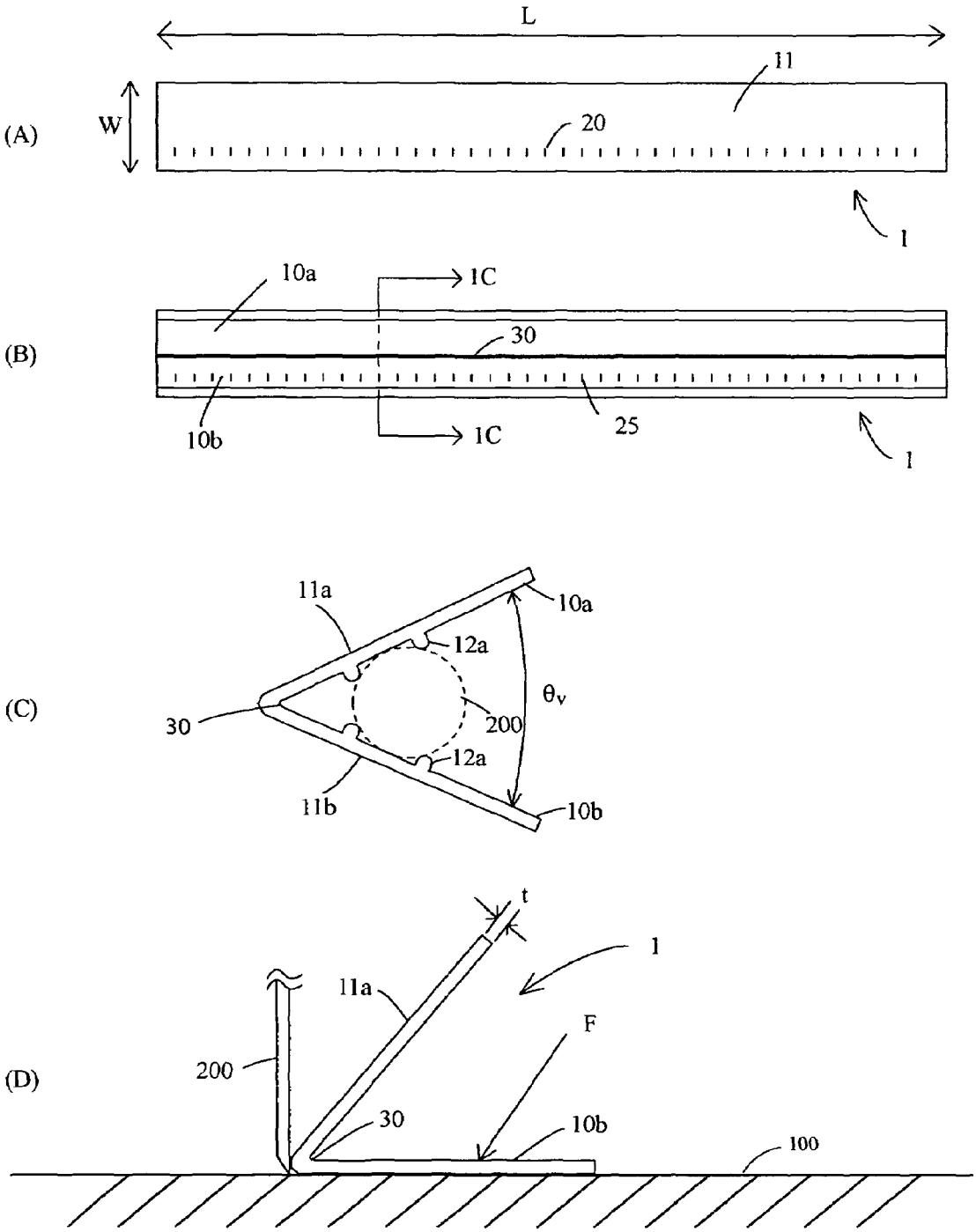
FIG. 1 shows (A) a side view; (B) a rear view; (C) a cross-sectional view at section C-C; and, (D) the relationship of the cross-section to a work surface for a first example.

An example of a cutting aid 1 is shown in FIG. 1. The cutting aid 1 may be a piece of material such as a metal or a plastic that has been formed into a length having a V-shaped cross section. The cutting aid 1 has a length L orthogonal to the V-shaped cross section, and the exterior sides or surfaces have a width W transverse to the length of the cutting aid 1. A view of one of the exterior surfaces 11 is shown in FIG. 1A. FIG. 1B shows the cutting aid 1 viewed from a rear perspective so that the interior surfaces 10*a, b* of the V-shaped cross section may be seen. FIG. 1C illustrates that the exterior surfaces 11*a, b* of the V-shaped cross section are disposed at an apex angle $\theta_v$ with respect to each other. When the cutting aid 1 is disposed on a surface 100 to be cut or marked, as shown in FIG. 1D, one of the exterior surfaces, for example 11*b*, may be positioned flat against the work surface 100 or a material to be cut or marked, and the other exterior surface 11*a* may be oriented at an angle $\theta_v$ with respect to the surface 100. A cutting tool 200 may be positioned against an outer portion of the apex 30 of the V-shaped cross-section and the cutting aid 1 used to guide the tool to cut, mark or scribe the surface 100. When in use, the cutting aid 1 may be held against the surface 100 by the user applying a pressure in a direction shown by the arrow F.

The cutting aid may be fabricated by extruding, molding, bending, forming, or other manufacturing technique. The thickness, t, of the material used for the sides of the V-shaped cross section is selected to provide sufficient mechanical strength to resist permanent deformation or fracture when subject to a pressure applied to an inner surface 10 thereof, when an opposing external surface 11 is placed on a substantially flat object, which may be the object or material to be cut or marked using the cutting aid 1 as a guide.

The cutting tool 200 or marker may be captivated to the cutting aid 1 when not in use as shown in FIG. 1C. Bosses 12*a, b*, spring clips, resilient materials, or the like, are sized and dimensioned so as to receive and secure the cutting tool 200 or marker. The dimensions may be such that the cutting tool 200 and the interior surface 10*a, b* of the V-shaped cross section have an interference fit, such that a small deflection of the V-shape occurs, and the cutting tool 200 is held in place by a restoring force applied by the cutting aid 1. Alternatively, a deformable resilient material may be applied to the inner surfaces of the V-shaped cross section along the length of the cutting aid 1 so that a cutting tool 200 or a marker of may be inserted therein. A length of the cutting tool 200 or marker may be disposed parallel to the length of the cutting aid 1, and pressed towards the apex 30 thereof so that the cutting tool 200 or marker is retained in the interior of the cutting aid 1 by friction and the restoring force applied by the resilient material.

Figure 2:
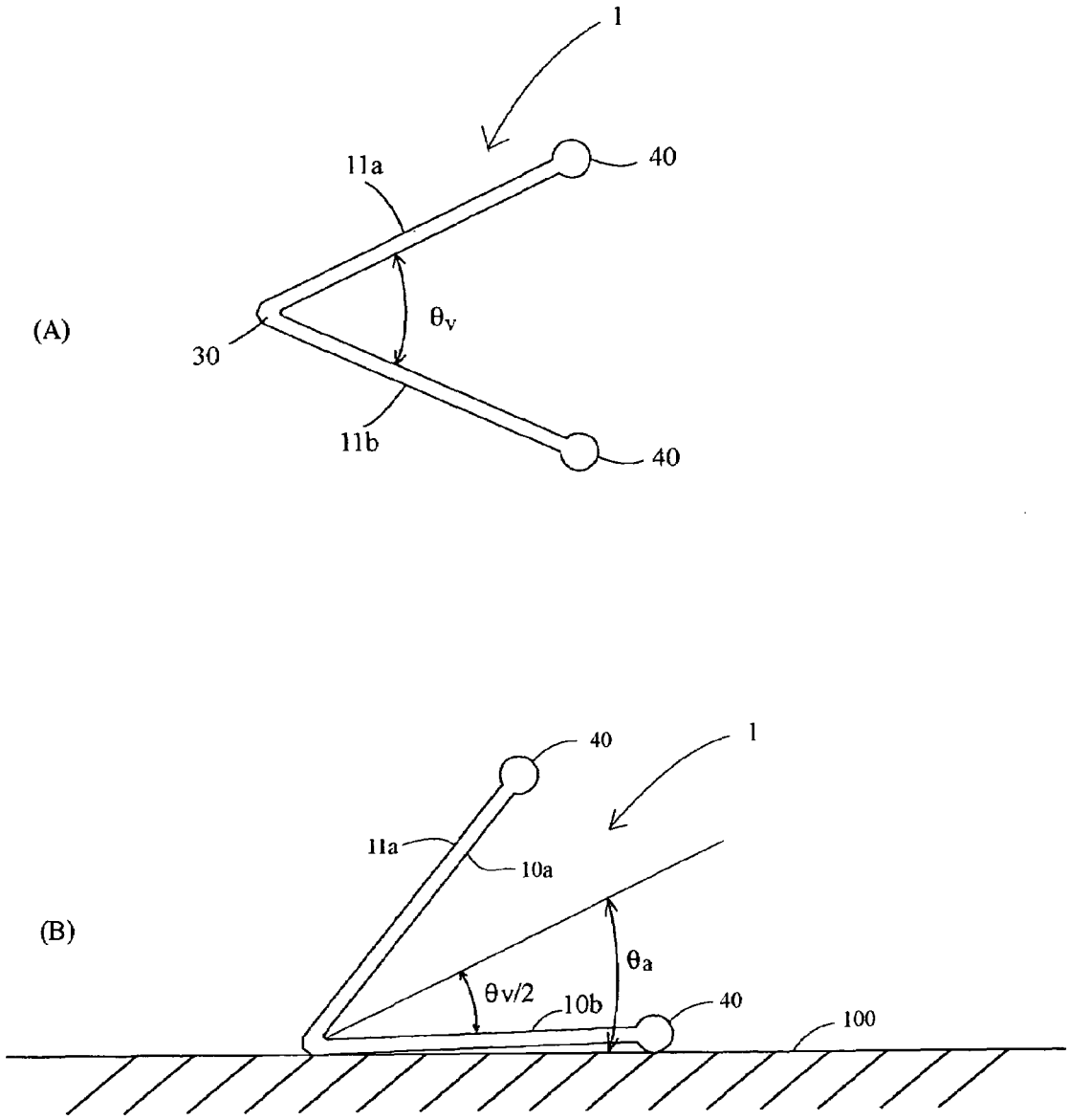
FIG. 2 shows: (A) a cross-sectional view; and, (B) the relationship of the cross-section to a work surface for a second example.

A bead 40 of material, shown in FIG. 2, may be formed on an edge of the side surfaces of the V-shaped cross-section, disposed distal from the join of the two sides of the V (the "apex" 30). The material used for the bead 40 may be the same material forming the V-shaped cross section, or another suitable engineering material. The cross-sectional dimension of the bead 40 is selected such that one end of the outer surface of the V-shaped cross section, distal from the apex 30 thereof, is supported against the material or surface 100 to be cut, and a slight gap exists between the exterior surface 11 of one side of the V-shaped cross section and the surface 100; the cutting aid 1 contacts the material to be cut at the bead 40 and at a location proximal to the apex 30. The orientation of the cutting aid 1, with respect to that in FIG. 1D, may be measured by the angle $\theta_a$ between the bisector of the central angle of the apex 30 of the V-shaped cross section and the surface 100. The angle $\theta_a$ is greater than the angle $\theta_v/2$ which would otherwise obtain between a flat exterior side 11*b*, without a bead 40, and the surface 100. As such, the side of the V-shaped cross section closest to the surface 100 may flex slightly when pressed on by the user, and facilitate the application of pressure to hold the cutting aid 1 against the surface 100 when the cutting tool 200 is being drawn along the length of the cutting tool 1, such that the cutting tool 1 may not slide out of position, and while protecting the hand applying the pressure from injury.

The surface properties of the bead 40 may be selected to increase the coefficient of friction between the cutting aid 1 and the material to be cut or marked or the surface 100, so as to resist movement in a direction transverse to the length of the cutting aid 1; that is, in the W direction. The material may be applied during an extruding process or a later time. A graduated scale may be applied.

Figure 3:
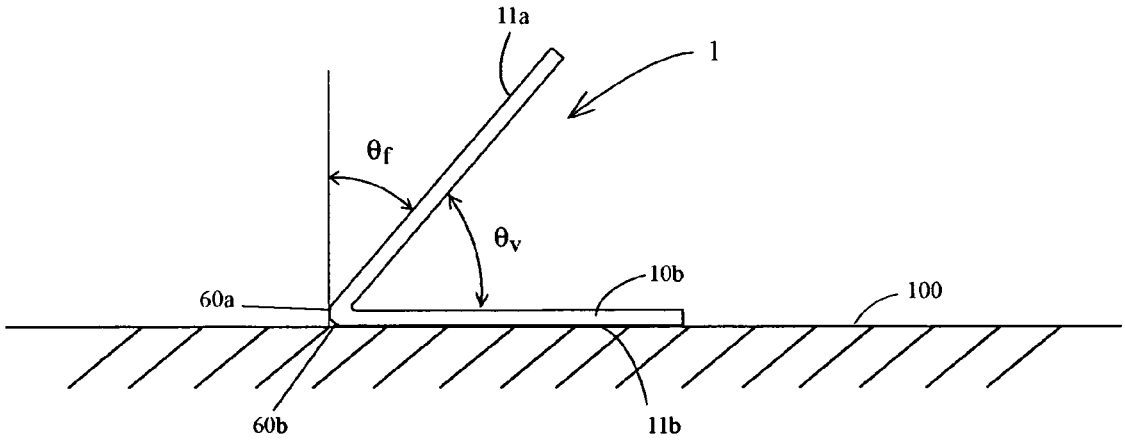
FIG. 3 shows a cross-sectional view and the relationship to a work surface for a third example.

In an aspect, an exterior surface of the apex 30 of the V-shaped cross section may be rounded or formed into another shape such as the V-shaped end 60 a, b shown in the cross-sectional view of FIG. 3. The exterior surface of the apex end portion 30 may have an apex angle that differs from that of the apex 30 of the V-shaped cross section, and the interior apex angle of surfaces 60*a, b* may be either greater or less than the apex angle θv of the V-shaped cross section, so as to form a guide edge portion. The edge portion 60 may be formed on the outer surface of the V-shaped cross section at the apex 30 thereof as two substantially flat segments extending along the length L of the cutting aid 1.

The angle $\theta_f$ formed between an extension of the plane of one of the flat surfaces, for example 60*a*, of the guide edge portion, and the outer surface 11*a* of the adjacent outer surface of the V-shaped cross section may be substantially the compliment of the interior angle apex $\theta_v$. A plane including the flat surface of the guide edge portion 60*a* may be substantially perpendicular to the surface 100 on which the cutting aid 1 has been placed, and may act as a guide to position the blade of a cutting tool along the line to be cut or marked. Since the same configuration obtains for the other exterior side surface of the V-shaped cross section and the corresponding surface of the edge portion, the cutting aid 1 may be laid on either exterior surface 11, and result in positioning of a guide edge portion 60 substantially perpendicular to the work surface 100. The angle $\theta_f$ may be varied with respect to being the compliment of the interior apex angle $\theta_v$, so as to orient the edge portion 60 at an angle other than substantially perpendicular to the work surface 100.

The length L of the cutting aid 1, in a direction orthogonal to the plane of the V cross-section, may be selected as one of conventional lengths, which may be approximately 6-inches, one foot, or one yard in the English system of units, or similar lengths, such as a meter, in other systems of units. Where graduations in two or more systems of units are provided, the length L may be a conventional length in one of the systems of units.

The thickness t of the material used for the sides of the V-shaped cross section depends on the type of material used, the environment in which the cutting aid 1 is to be used, and durability and ergonometric considerations. For example, a cutting aid having a length L of one foot and fabricated from a metal such as aluminum may have a material thickness of between about 0.02 and about 0.06 inches. For a plastic material, a thickness of about 0.06 to about 0.10 inches may be used.

In another aspect, a graduated scale 20 as shown in FIG. 1A may be applied to an exterior surface 11 of the cutting aid 1 and positioned proximal to the apex 30 of the V-shaped cross section and extending along the length L of the cutting tool 1 so as to provide indicia for measuring, or otherwise selecting or marking distances which may be cut by the cutting tool 200 using the cutting aid 1 as a guide. Differing scales such those conforming to the metric or English measuring systems may be applied to opposing exterior sides 11*a, b* of the V-shaped cross section so that multiple measuring functions may be performed. Other measuring systems may be used, as in conventional triangular engineer's rules, or a special-purpose scale may be provided. The graduations may be applied by machine ruling, engraving, etching, pasting a preprinted strip, screen printing, or the like, depending on the precision of measurement and durability requirements of the specific product. A graduated scale 25 may also be applied to the interior surface 10 of the V-shaped cross section, and positioned distal from the apex 30 of the V-shaped cross section so as to be useful in measuring distances. In an aspect, the graduated scale 25 may be formed as part of a molding process, or applied by any of the techniques previously described.

The cutting aid 1 is used by placing one of the exterior surfaces 11 against a work surface 100 on which the material to be measured or cut is laid, and orienting the cutting aid 200 such that an edge of the cutting tool is oriented above, and substantially coincident with, an imaginary line on the work surface 100 representing the desired mark or cut on the material to be measured or cut.

The user may insert a portion of one hand into the portion of the V cross-section formed by the interior surfaces 10 of the V-shaped cross section, and press down on the interior surface 10*b* opposing the exterior surface 11*b* in contact with the material or surface 100 to be cut. The user may apply pressure by hand so that the cutting aid 1 is not moved from a desired position by forces applied through a marker, such as a pencil, pen or like, or by a cutting tool 200 of the types previously described or having a similar function. Cutting tools may have fixed or rotatable blades. The marker or cutting tool 200 is brought into contact with a face of the guide edge (such as surface 60*a* in FIG. 3). The marker or cutting tool may be oriented such that a plane formed by the guide edge 60*a* with which the cutting tool is in contact, and a plane coincident with the blade of the cutting tool may be substantially parallel to each other, and may be substantially coincident with each other. Typically, the top end of the marker or cutting tool may be inclined in the direction of intended motion along the length of the cutting aid 1.

Using the other hand, the user may apply pressure to the marker or cutting tool to force an operative end of the marker or cutting tool 200, such as a blade, against the material to be marked or cut, and a sideways or transverse pressure may be simultaneously applied to aid in maintaining contact between a portion of the marker or cutting tool 200 and the edge 60*a* or *b* of the cutting aid 1, as appropriate, thus resulting in a line mark or cut.

Figure 4:
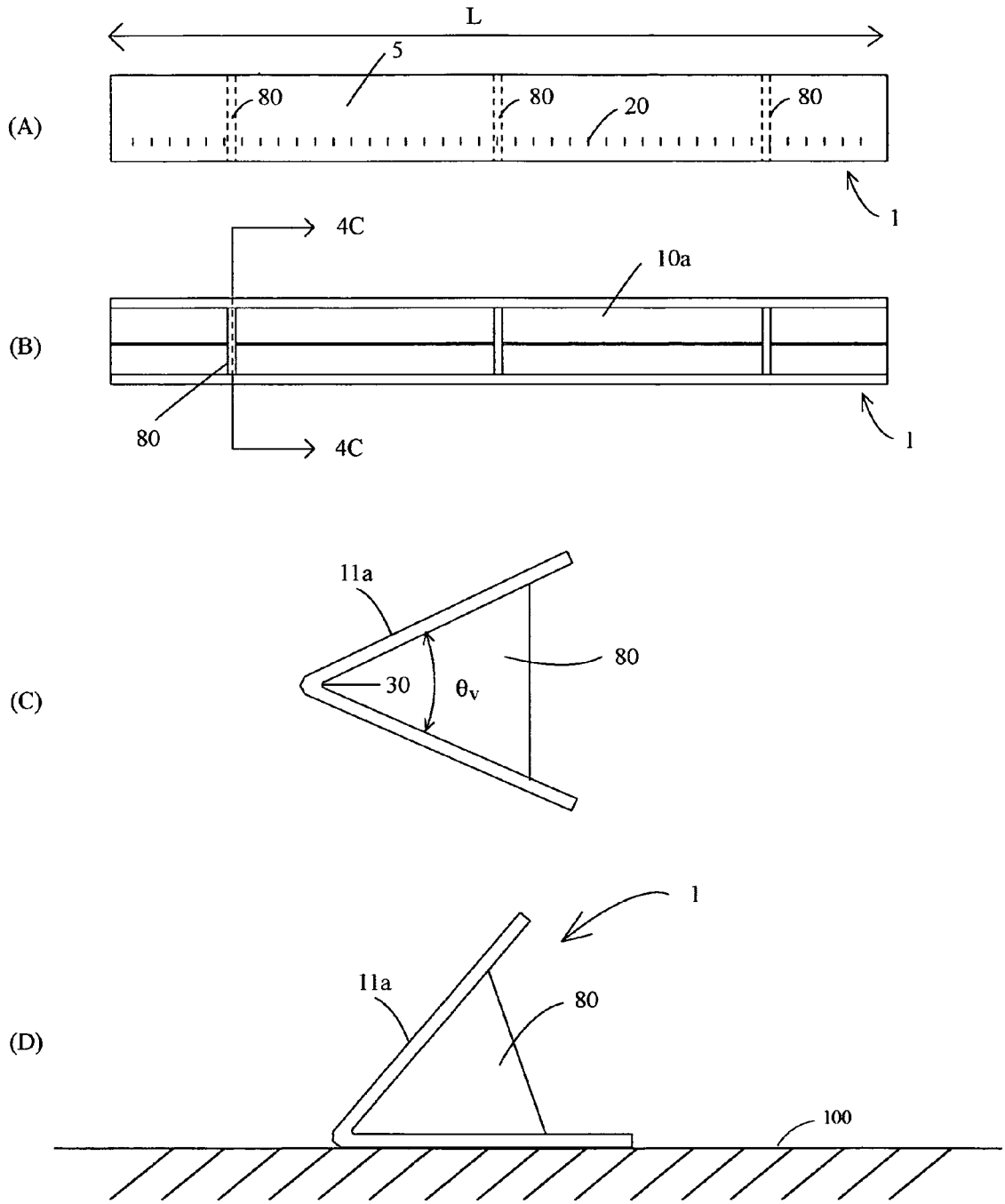
FIG. 4 shows: (A) a side view; (B) a rear view; (C) a cross-sectional view at section C-C; and, (D) the relationship of the cross-section to a work surface for a fourth example.

An example of a molded cutting aid 1 is shown in FIG. 4. The overall shape and use of the cutting aid 1 is similar to that previously described, and only significant differences will be described. Where the material used to form the cutting aid is a plastic or thin metal, for example, a reinforcement of the V-shaped cross section for purposes of increasing the durability may be provided by webs 80 having a generally V shape, conforming to the interior surfaces 10*a, b* of the V-shaped cross section, and formed at intervals along the length L of the cutting aid 1. The spacing of the webs 80 in the length direction L is selected so that a user may insert at least a portion of one hand into the region between the webs 80 so as to hold the cutting aid 1 in position when in use.

A person of ordinary skill in the art will that recognize that, for example, the webs 80 may be replaced by a continuous section having a V shape and extending only part of the distance between the apex 30 of the V-shaped cross section and the distal edges of the surfaces of the V-shaped cross section or similar structures so as to strengthen the cutting aid 1. Also, the interior angle may be replaced by a suitable radius of the material forming the V-shaped cross section.

Figure 5:
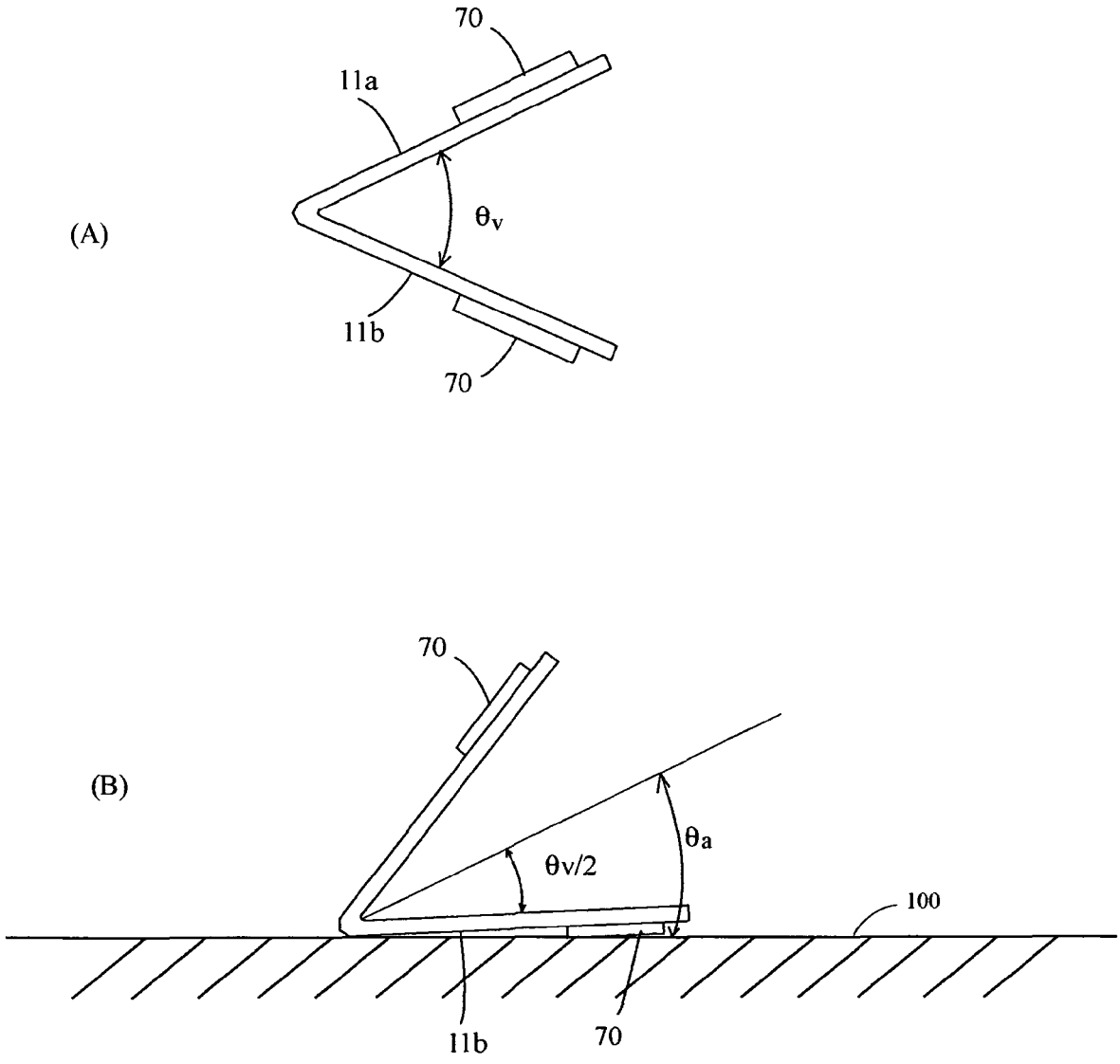
FIG. 5 shows: (A) a cross-sectional view; and, (B) the relationship of the cross-section to a work surface for a fifth example.

A bead 40 may be formed on an edge of the V-shaped cross section distal from the apex 30 thereof, as in the example shown in FIG. 2, or a strip 70 of material with a high coefficient of friction applied to the exterior surface 11 along the all or a portion of the length L of the cutting aid 1 at a location between the apex 30 of the V-shaped cross section and the distal edge of the sides 11 of the V-shaped cross section, as shown in FIG. 5. The strip 70 may be continuous or discontinuous, and multiple strips may be used. Materials such as thermoplastic rubber, thermoplastic elastomer or materials having similar properties may be used to provide the higher friction material. The material may be compressible, so that a larger contact area between the strip 70 and the surface 100 may be obtained when pressure is applied to the inner surface of the V-shaped cross section. The material may be applied by overmolding, extruding, co-extruding or gluing or other suitable process.

When positioned with one external surface, for example 11*b*, against the surface 100, the strip 70 is interposed between a portion of the external surface 11*b* and the surface 100, so that the cutting aid 1 is rotated with respect to the position shown in FIG. 1, in a manner similar to that shown in FIG. 2. As such the angle $\theta_a$ is greater than $\theta_v/2$. When a cutting aid 1 of the shape shown in FIG. 3 is used, and it is desired to orient either one of the guide faces 60 substantially perpendicular to the work surface 100, the complimentary angle $\theta_f$ may be determined approximately with respect to the angle $\theta_a$ between the bisector of the V-shaped cross-section and the surface 100, rather than the apex angle $\theta_v$ of the V-shaped cross section.

Figure 6:
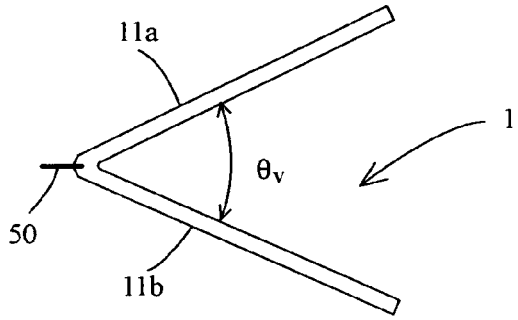
FIG. 6 shows a cross-sectional view of a sixth example.

The guide edge portion along the outer portion of the apex 30 of the V-shaped cross section may be formed as previously described, or an edge piece 50 inserted in, or formed in, the outer apex of the V-shaped cross section during the manufacturing process, as shown in FIG. 6. The edge piece 50 may extend along all, or substantially all, of the length L of the cutting aid 1. The edge piece 50 is positioned so as to be the bisector of the exterior angle of the V-shaped cross section and extend from an outer surface of the apex 30 of the V-shaped cross section at an angle towards the surface 100 on which the cutting aid 1 may be positioned.

The edge piece 50 may be made of a metal such as cold rolled steel, stainless steel, aluminum, or brass; however, it is equally possible to mold or extrude a similar shape to achieve the same purpose. When molding or extruding, a person of ordinary skill in the art will recognize that some radiusing or relieving of surfaces will be part of the design.

Although only a few exemplary embodiments have been described in detail above, it should be understood by an ordinary skilled person in the art that the invention is not limited to the embodiments, but rather that various changes or modifications thereof are possible without departing from the spirit of the invention. Accordingly, the scope of the invention shall be determined only by the appended claims and their equivalents.

The invention claimed is:

1. A apparatus for aiding marking or cutting a flat object, comprising:

a length of a first material having a V-shaped cross section with an apex formed by an intersection of planes coincident with a first exterior surface and a second exterior surface of the V-shaped cross section; and, a third and a fourth exterior surface of an apex of the V-shaped cross section are substantially flat surfaces extending along a length of the apparatus, wherein a flat portion of each of the first exterior surface or the second exterior surface is separately positionable in contact with a surface of the flat object, while the other of the first exterior surface or the second exterior surface is not in contact with the surface of the flat object, and an interior angle between the first exterior surface and the second exterior surface is an acute angle; the third and fourth the flat surfaces are symmetrically disposed with respect to an axis of symmetry of the V-shaped cross section, and an angle formed between a plane passing through a flat surface of the flat surfaces and a plane passing through an adjoining one of the first or the second surfaces is approximately the compliment of an internal apex angle of the V-shaped cross section.

2. The apparatus of claim 1, wherein a graduated scale is formed on the first exterior surface.

3. The apparatus of claim 2, wherein the graduated scale is formed on an interior surface of the V-shaped cross section.

4. The apparatus of claim 2, wherein a measurement system of the graduated scale is at least one of the English system of units or the metric system of units.

5. The apparatus of claim 1, further comprising a second material having a higher coefficient of friction than the first material, wherein the second material is applied to, or formed on, an edge of the at least one of the first exterior surface or the second exterior surface, the edge being disposed distal from the apex.

6. The apparatus of claim 1, further comprising a third material having a higher coefficient of friction than the first material, wherein the third material is applied to, or formed on, a portion of at least one of the first exterior surface or the second exterior surface.

7. The apparatus of claim 1, wherein the plane passing through one of the third or fourth exterior surfaces is perpendicular to the plane passing through a non-adjacent one of the first or the second exterior surfaces.

8. The apparatus of claim 1, wherein a thin strip is disposed at an exterior surface of a junction of the first exterior surface and the second exterior surface such that a portion of the strip is embedded in the V-shaped cross section, and a portion of the strip extends outward from V-shaped cross section along a plane that is a bisector the interior apex angle.

9. The apparatus of claim 8, wherein the thin strip is a made of a metal.

10. The apparatus of claim 9, wherein the metal is one of cold rolled steel, stainless steel, aluminum, or brass.

11. The apparatus of claim 8, wherein the thin strip is a laminate.

12. The apparatus of claim 1, wherein an exterior edge is formed at an intersection of a plane coincident with a third exterior surface and a plane coincident with a fourth exterior surface, and an interior angle formed by and intersection of the planes coincident with the third exterior surface and the fourth exterior surface is greater than the interior apex angle of the V-shaped cross section.

13. The apparatus of claim 12, wherein the plane coincident with one of a the third exterior surface or the fourth exterior surface is substantially perpendicular to the plane coincident with the first exterior surface.

14. The apparatus of claim 1, further comprising:

bosses or springs disposed on an interior surface, sized and dimensioned to receive or retain a cutting tool or marker.

15. The apparatus of claim 14, wherein the cutting tool or marker is retained by a restoring force exerted by the V-shaped cross section or the springs.

16. The apparatus of claim 1, further comprising a resilient material applied to an interior surface of the apparatus, the resilient material sized and positioned so as to form an interference fit with an inserted cutting tool or marker and to retain the cutting tool or marker by at least one of a restoring force applied by the resilient material or by frictional forces between the resilient material and the cutting tool or marker.

17. An apparatus for aiding marking or cutting, comprising:

a length of a first material having a V-shaped cross section with a first exterior surface and a second exterior surface, arranged such that a plane coinciding with the first exterior surface and a plane coinciding with the second exterior surface have an intersection such that an acute interior angle is formed therebetween; and a layer of a second material formed on, or applied to, at least one of the first or the second exterior surfaces, or an edge of the V-shaped cross section, at a location distal from the intersection of the planes, wherein each one of the first exterior surface or the second exterior surface is separately positionable in close proximity to a surface of a flat object; and, a coefficient of friction of the second material is greater than a coefficient of friction of the first material; and, a web having a V-shape is disposed orthogonal to the length and to an interior surface of the V-shaped cross section.

18. The apparatus of claim 17, wherein the distance between the layer of the second material applied to the first exterior surface or the second exterior surface and the intersection is greater than half the distance between the intersection and an edge of the exterior surface distal from the intersection.

19. The apparatus of claim 17, wherein a plurality of web stiffeners is disposed along the length.

20. The apparatus of claim 17, wherein the second material is resiliently deformable.

* * * * *